US005487432A

United States Patent [19]

Thompson

[11] Patent Number: 5,487,432

[45] Date of Patent: Jan. 30, 1996

[54] SUBSURFACE TOOL

[76] Inventor: Jon E. Thompson, 30 White Hills, NE., Grand Rapids, Mich. 49546

[21] Appl. No.: 392,096

[22] Filed: Feb. 22, 1995

[51] Int. Cl.[6] ..... E21B 49/02

[52] U.S. Cl. ..... 175/20; 175/84; 175/135

[58] Field of Search ..... 175/18, 20, 58, 175/84, 135, 316

[56] References Cited

U.S. PATENT DOCUMENTS

| | | | |
|---|---|---|---|
| 185,024 | 12/1876 | Gent | 175/20 |
| 2,382,992 | 8/1945 | Harris | 175/20 |
| 4,098,360 | 7/1978 | Clements | 175/58 X |
| 4,556,114 | 12/1985 | Ryan | 175/20 |
| 5,186,263 | 2/1993 | Kejr et al. | 175/58 X |
| 5,275,245 | 1/1994 | Clements | 175/20 |
| 5,330,014 | 7/1994 | Wagner | 175/18 |
| 5,408,893 | 4/1995 | McLeroy | 175/20 X |

*Primary Examiner*—Frank S. Tsay
*Attorney, Agent, or Firm*—Price, Heneveld, Cooper, DeWitt & Litton

[57] ABSTRACT

A subsurface tool comprising an elongated steel shaft having a soil penetrating lower end element and having a threaded upper end, a transverse elongated handle having a pair of ends for manual gripping thereof, and a central zone, an elongated isolator between the shaft upper end and the handle, the isolator being an electrically insulating, reinforced polymeric composite having an upper end ring portion encircling and molded to the handle at its central zone, and having a lower end socket, the shaft upper end being attached to the isolator lower end socket.

6 Claims, 2 Drawing Sheets

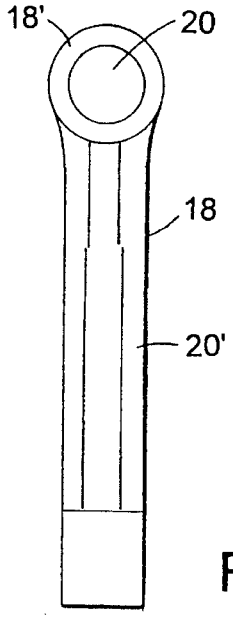
Fig. 4
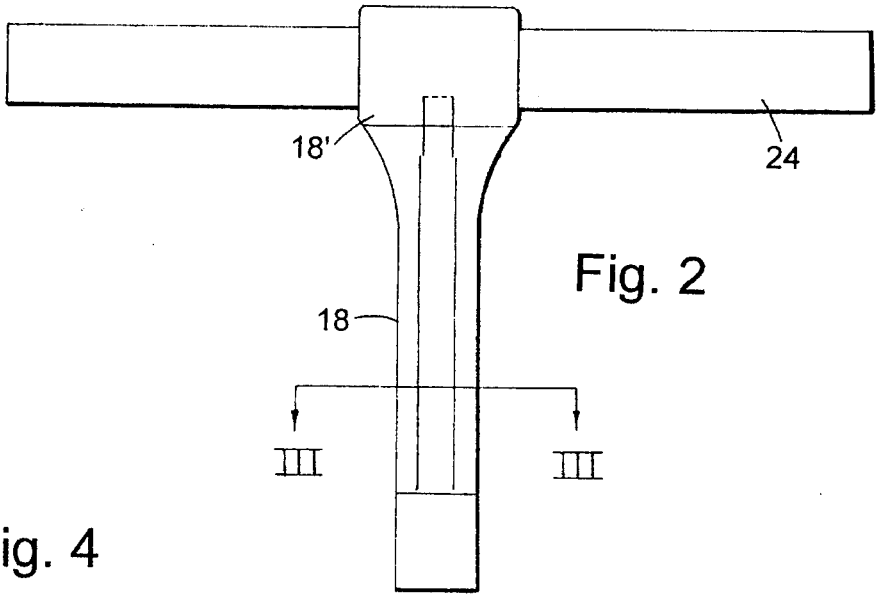
Fig. 2
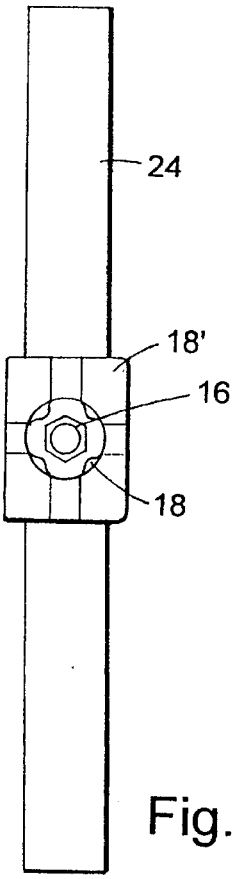
Fig. 5
Fig. 3
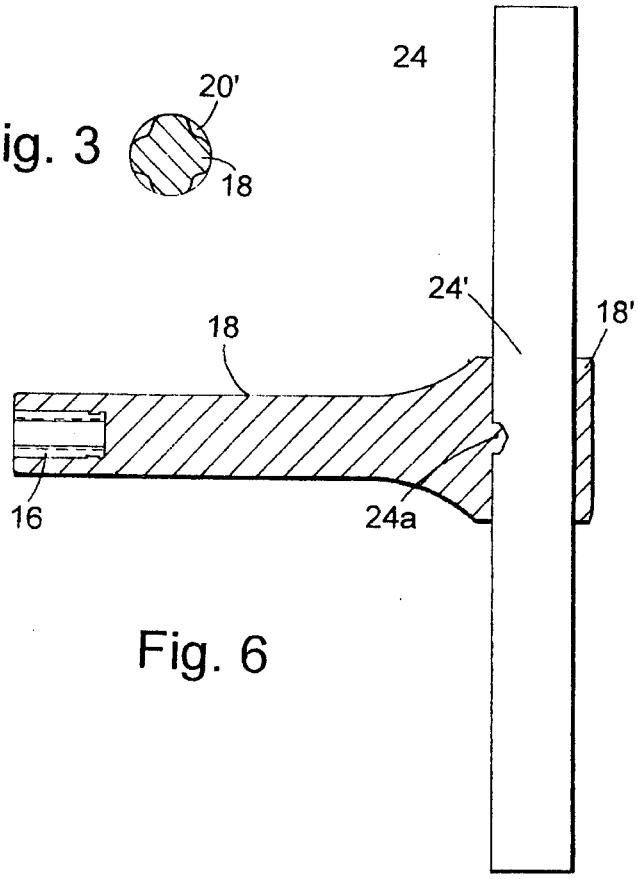
Fig. 6

SUBSURFACE TOOL

BACKGROUND OF THE INVENTION

This invention relates to subsurface, i.e., underground, soil penetrating tools such as soil probes and soil augers, and particularly to such tools which offer special safety to the operator from electrical shorting. Detection probes and soil augers of various types have been devised heretofore for being manually forced down into the ground, e.g., to locate a conduit, a pipe, a storage tank, a septic tank or other buried objects, or to auger out soil samples and the like. To operate the tool, the operator grips a transverse handle on the upper end of a shaft having a pointed tip or an auger bit on its lower end, and advances the shaft down into the ground. When using such tools, one serious concern for the operator is the possibility of engaging a buried electrical conductor. The pointed tip or auger bit enables the tool to inadvertently penetrate the insulation of the electrical conductor, to potentially cause electrical shorting to the operator. This can cause injury or death to the operator and persons standing nearby.

In attempts to lessen this potential danger, some soil penetrating tools have an insulative jacket on the handle, as is true for the prior art probe in FIG. 7 herein. Other tools which have been marketed have a fiberglass reinforced polymeric shaft with an attached lower end pointed tip or auger bit for penetration of the ground. However, it has been discovered that if the polymeric shaft surface is nicked or scratched by the soil or rocks, moisture can penetrate and wick into the shaft interior to cause the tool to become unexpectedly electrically conductive. Another potential problem with reinforced polymeric shaft elements on probes and augers is that heavy stress, particularly if not oriented directly axially of the shaft, can cause the polymeric shaft to break. Hence, workmen may prefer to have the stronger steel shaft previously used rather than a plastic shaft. However, steel is electrically conductive, so that the safety of the operator is dependent on the layer of plastic insulation jacketing the handle.

SUMMARY OF THE INVENTION

An object of this invention is to provide a special soil penetrating tool construction that has the strength of a steel shaft and yet is safe from electrical shorting to the operator. The probe or auger employs a lower steel shaft with a pointed tip or auger bit on its lower end, a handle having an electrically insulative surface, and in combination with an intermediate electrical isolator coupling between the handle and shaft, and connecting the handle and shaft. Although this isolator couples the handle and shaft together, it fully electrically insulates the handle from the shaft. The isolator is elongated, and is diametrically enlarged for strength. It is formed of a reinforced composite material, preferably a glass fiber reinforced polyurethane. It does not penetrate the ground. It has its lower end threadably attached to the upper end of the steel shaft, preferably using a metal insert sleeve, and has an integral upper end ring which is molded around and encircles the center of the transverse handle. The handle preferably has a core as of metal, enveloped by a polymeric, electrically insulating, molded covering as of polyvinylchloride jacketing the handle. The isolator is interconnected with the handle to prevent slippage of the handle relative to the isolator.

DESCRIPTION OF THE DRAWINGS

FIG. 2 is a side elevational view of the upper portion of the probe showing the handle and the electrical current isolator;

FIG. 3 is a sectional view taken on plane III—III of FIG. 2;

FIG. 4 is an end elevational view of the structure in FIG. 2;

FIG. 5 is a bottom elevational view of the structure in FIG. 4;

FIG. 6 is a sectional view of the structure in FIG. 2; and

DESCRIPTION OF THE PREFERRED EMBODIMENT

Figure 1:
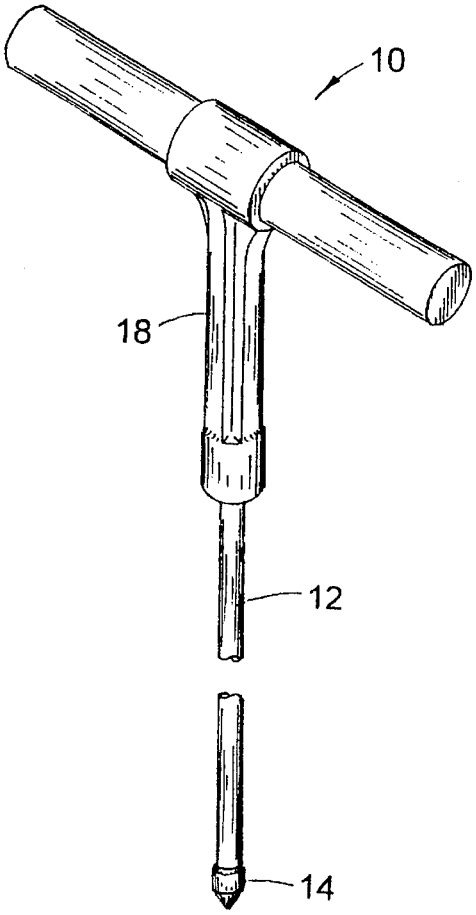
FIG. 1 is a perspective view of a novel probe showing my invention.

Referring now to the drawings, the novel tool is depicted there in the form of a probe 10 (FIG. 1). It has an elongated lower steel shaft 12 preferably formed of an alloy steel to be particularly strong, and has a threaded lower end onto which is threadably attached a penetrating element shown as a pointed tip 14 in conventional fashion. This tip is threadably removable so that, if damaged, it can be replaced. The upper end of steel shaft 12 preferably has male threads threadably engaged with isolator 18, preferably into a metal insert sleeve 16 (FIG. 6) embedded in the lower end of elongated isolator coupling 18. Sleeve 16 has female threads on its inner diameter and preferably has an polygonal shape, e.g., hexagonal as shown (FIG. 5). At the upper end of elongated isolator coupling 18 is an integral, ring-shaped sleeve 18' defining a generally cylindrical opening 20 therethrough. The axis of opening 20 is normal to the vertical axis of elongated isolator coupling 18. Isolator 18 is formed of an electrically insulating composite material reinforced by fibers, e.g., fiberglass or carbon filaments reinforcing polyurethane polymer, the fiber content preferably in an amount of about 40%. It is of enlarged diameter relative to the diameter of shaft 12, typically for example having a diameter of about one inch as compared to three-eighths inch diameter for shaft 12. A plurality of elongated indentations 20' in the outer periphery of isolator 18 are for strength and appearance.

Extending through cylindrical opening 20 of ring 18' is a transversely oriented handle 24. This handle is on an axis which is normal to the axis of isolator 18 and shaft 12. It has two outer ends straddling a central zone 24', the central zone being encompassed by isolator ring 18' which is molded thereto. The two handle ends are for manual gripping by the operator. In central zone 24', the handle has a radial recess **24*a* into which the composite polymeric material of isolator 18 is molded (FIG. 6). This locks the handle in place to prevent the handle from slipping relative to the isolator. Preferably handle 24** also is jacketed in conventional manner by a polymeric jacket as of polyvinylchloride to add further electrical insulation as well as comfort to the hands of the operator.

In use, the operator grasps the ends of handle 24 and manually pushes the pointed tip and steel shaft down into the ground to a depth up to the bottom end of the isolator, to probe for underground devices, while being protected from any electrical shorting which might occur with inadvertent penetration of an insulated electrical conductor by the probe tip. Tests by an independent testing laboratory have established protection from voltages even as high as 50,000 volts, whether the probe is dry or has been subjected to water soak conditions. Alternatively, if the penetrating element 14 is a conventional small helical auger bit rather than a pointed tip, the soil penetrating tool is rotated while being pushed down, to auger penetrate the bit and shaft 12 into the soil. The same protection is provided as explained above.

Figure 7:
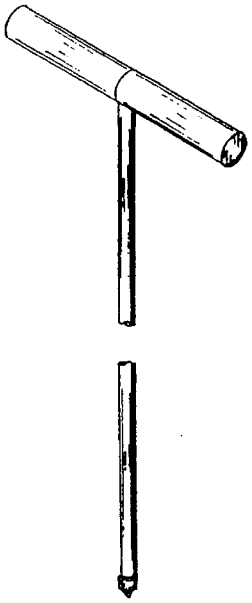
Fig. 7 PRIOR ART
FIG. 7 is a perspective view of a prior art probe.

FIG. 7 illustrates a prior art probe which has a steel alloy shaft with a threaded lower tip and the upper end threaded into a handle jacketed by polyvinylchloride polymer.

Conceivably minor variations may be made in the novel structure shown and described without departing from the invention described, and which is intended to be limited only by the scope of the appended claims and the reasonably equivalent structures to those defined therein.

The embodiments of the invention in which an exclusive property or privilege is claimed are defined as follows:

1. A soil penetrating tool comprising an elongated steel shaft having a pointed lower end penetrating element and having a threaded upper end;

a transverse elongated handle having a rigid core and a polymeric, electrically insulative jacket around said core;

said handle having a pair of ends for manual gripping thereof, and a central zone;

an elongated isolator between said shaft upper end and said handle, said isolator being an electrically insulating, reinforced polymeric composite having an upper end ring portion encircling and molded to said handle at said central zone, and having a lower end threaded socket; and said shaft upper end being threadably attached to said isolator lower end threaded socket.

2. A soil penetrating tool comprising:

a shaft having an upper end and a soil penetrating lower end element;

a transverse elongated handle having a pair of ends for manual gripping thereof, and a central zone; and an isolator coupling between said shaft and said handle, said coupling being an electrically insulating element having an upper end secured to said handle central zone, and having a lower end secured to said shaft upper end.

3. The soil penetrating tool in claim 2 wherein said isolator coupling is of a reinforced composition and has a threaded socket at its said lower end, said shaft having a male threaded upper end threadably engaged in said threaded socket.

4. The soil penetrating tool in claim 2 wherein said threaded socket comprises a metal sleeve insert.

5. The soil penetrating tool in claim 2 wherein said isolator coupling upper end comprises an integral ring encircling said handle central zone.

6. The soil penetrating tool in claim 1 wherein said reinforced polymeric composite comprises fiber reinforced polyurethane polymer.

* * * * *